US008025431B1

(12) United States Patent
Burke

(10) Patent No.: US 8,025,431 B1
(45) Date of Patent: Sep. 27, 2011

(54) CLEAT WITH ILLUMINATION

(76) Inventor: David W. Burke, Bay City, MI (US)

( * ) Notice: Subject to any disclaimer, the term of this patent is extended or adjusted under 35 U.S.C. 154(b) by 257 days.

(21) Appl. No.: 12/508,527

(22) Filed: Jul. 23, 2009

Related U.S. Application Data

(60) Provisional application No. 61/083,153, filed on Jul. 23, 2008.

(51) Int. Cl.
*F21V 21/00* (2006.01)

(52) U.S. Cl. ..... 362/391; 362/249.02; 362/477; 114/218

(58) Field of Classification Search ..... 362/240, 362/244, 249.01, 249.02, 285, 310, 311.01, 362/311.02, 327, 477, 800; 114/218
See application file for complete search history.

(56) References Cited

U.S. PATENT DOCUMENTS

| | | | |
|---|---|---|---|
| 1,668,544 | A | 6/1927 | Armstrong et al. |
| 4,057,439 | A | 11/1977 | Lindmayer |
| 4,241,493 | A | 12/1980 | Andrulitis et al. |
| 4,999,060 | A | 3/1991 | Szekely et al. |
| 5,055,984 | A | 10/1991 | Hung et al. |
| D323,567 | S | 1/1992 | Denison et al. |
| 5,216,972 | A | 6/1993 | Dufrene et al. |
| 5,362,267 | A | 11/1994 | Forrest |
| D391,384 | S | 2/1998 | Lerch |
| 5,879,472 | A | 3/1999 | Ronwin |
| 6,009,824 | A | 1/2000 | Ross |
| 6,046,400 | A | 4/2000 | Drummer |
| 6,086,220 | A | 7/2000 | Lash et al. |
| 6,539,886 | B2 | 4/2003 | Henry et al. |
| D494,536 | S | 8/2004 | Pu |
| 6,840,186 | B1 | 1/2005 | Steele |
| 6,874,905 | B1 | 4/2005 | Beadle |
| 6,883,944 | B2 | 4/2005 | LeBoeuf |
| D506,126 | S | 6/2005 | Amy |
| 6,929,381 | B2 | 8/2005 | Peterson |
| 6,968,796 | B1 | 11/2005 | Burke |
| 7,320,631 | B1 | 1/2008 | Distefano et al. |
| 7,473,016 | B2 | 1/2009 | Flaherty et al. |
| 2006/0044785 | A1 | 3/2006 | Lee |
| 2006/0076047 | A1 | 4/2006 | Green et al. |

*Primary Examiner* — Hargobind Sawhney
(74) *Attorney, Agent, or Firm* — Robert L. Farris; Farris Law, P.C.

(57) ABSTRACT

The cleat includes a bridge supported by first and second columns. Both columns include two wings with bottom support surfaces. A horn is integral with each column and extends away from the bridge. An illumination module cavity with an open top is formed in the bridge. A cavity bottom includes a light aperture that passes through the bridge. An illumination module with a transparent case is pressed into the illumination module. A light emitting diode inside the case directs light downward through the light aperture. A photovoltaic cell array in the top of the case energizes the diode.

5 Claims, 6 Drawing Sheets

CLEAT WITH ILLUMINATION

CROSS REFERENCE TO RELATED APPLICATIONS

This application claims the benefit of the filing date of U.S. Provisional Application No. 61/083,153 titled CLEAT WITH ILLUMINATION, filed Jul. 23, 2008.

TECHNICAL FIELD OF THE INVENTION

The cleat with illumination is attachable to a watercraft and is illuminated to indicate cleat location during periods of low visibility by an encased light source powered by a photovoltaic cell.

BACKGROUND OF THE INVENTION

Cleats are secured to watercraft for attachment of mooring lines. During periods of reduced visibility illumination has been found to be helpful. Locating cleats in the dark is much easier if the cleats are illuminated. An illuminated cleat can also indicate a person's location on a watercraft and thereby potentially prevent the person from falling from the watercraft.

Cleats have been illuminated by tubes filled with trinium gas, incandescent lamps, and by light emitting diodes. The trinium gas is radioactive. The gas has become too expensive due to government regulations. Incandescent lamps require electricity. The electricity can be provided by a generator or by a battery. Both sources of electricity require wires that pass through a bore through the deck or other structure of a watercraft. Wires deteriorate in high moisture conditions. Holes bored through a watercraft deck can leak when a sealant deteriorates. Batteries need to be recharged from time to time or to be replaced.

Light emitting diodes fail from time to time. Replacement of failed light emitting diodes can be difficult or even impossible. The time required to replace a diode, when replacement is possible, may be significant. Multiple tools may be required. Supplies such as solder and sealants may also be required.

SUMMARY OF THE INVENTION

The cleat with illumination includes a bridge. The bridge has a bridge first end, a bridge second end, a bridge first side, a bridge second side, a bridge bottom surface and a bridge top surface. A first column is integral with the bridge first end and extends downward from the bridge bottom surface. A second column is integral with the bridge second end and extends downward from the bridge bottom surface.

A first column base is integral with the first column. A first wing extends from a column first side of the first column and away from the bridge first side. A first vertical fastener receiving bore passes through the first wing and has a first bore axis. A second wing extends from a column second side of the first column and away from the bridge second side. A second vertical fastener receiving bore, with a second bore axis, passes through the second wing. The second bore axis is parallel to the first bore axis.

A second column base is integral with the second column. A third wing extends from a column first side of the second column and away from the bridge first side. A third vertical fastener receiving bore passes through the third wing and has a third bore axis. A forth wing extends from a column second side of the second column and away from the bridge second side. A fourth vertical fastener receiving bore with a fourth bore axis passes through the fourth wing. The fourth bore axis is parallel to the third bore axis.

A first horn is integral with the first column, extends away from the bridge first end and extends to a first horn free tip that extends above the bridge top surface. A second horn is integral with the second column, extends away from the bridge second end, and extends to a second horn free tip. The second horn free tip extends above the bridge top surface.

An illumination module cavity includes a first side cavity wall integral with the bridge and extending laterally outward from the bridge first side. The first side cavity wall has a first side cavity wall top surface that is at the same elevation as the bridge top surface. A first side cavity bottom wall is integral with the first side cavity wall and the bridge and above the bridge bottom surface. A second side cavity wall is integral with the bridge, extends laterally outward from the bridge second side. A second side cavity wall top surface is at the same elevation as the bridge top surface. A second side cavity bottom wall is integral with the second side cavity wall and the bridge and above the bridge bottom surface. A cylindrical cavity wall surface is formed on the first side cavity wall, the second side cavity wall and the bridge. The illumination module cavity has a cavity open top and a light passage aperture through the bridge that is coaxial with a vertical cylinder axis of the cylindrical cavity wall surface.

An illumination module includes a transparent plastic case with a photovoltaic cell array mounted under a case top wall. A light emitting diode is mounted in the center of the transparent plastic case below the photovoltaic cell array. An upper side wall of the transparent plastic case is exposed above the bridge top surface and exposed between a case radially outer wall and a photovoltaic cell outer edge. The illumination module is positioned in the illumination module cavity with the photovoltaic cell array facing upward, the light emitting diode in axial alignment with the light passage aperture and held in the illumination module cavity by friction.

During periods of limited light, the illumination module energizes the light emitting diode and light passes through the light passage aperture. A cavity inside surface reflects light upward and through the upper side wall of the transparent plastic case exposed above the bridge top surface and the photovoltaic cell outer edge.

The first column base includes a first cleat bottom surface on the first wing and a second cleat bottom support surface on the second wing. The second column base includes a third cleat support bottom surface on the third wing and a forth cleat support bottom surface on the fourth wing. The first cleat support bottom surface, the second cleat support bottom surface, the third cleat support bottom surface, and the fourth cleat support bottom surface are in a common plane.

BRIEF DESCRIPTION OF THE DRAWINGS

The presently preferred embodiments of the invention are disclosed in the following description and in the accompanying drawings, wherein.

DETAILED DESCRIPTION OF THE PREFERRED EMBODIMENT

Figure 1:
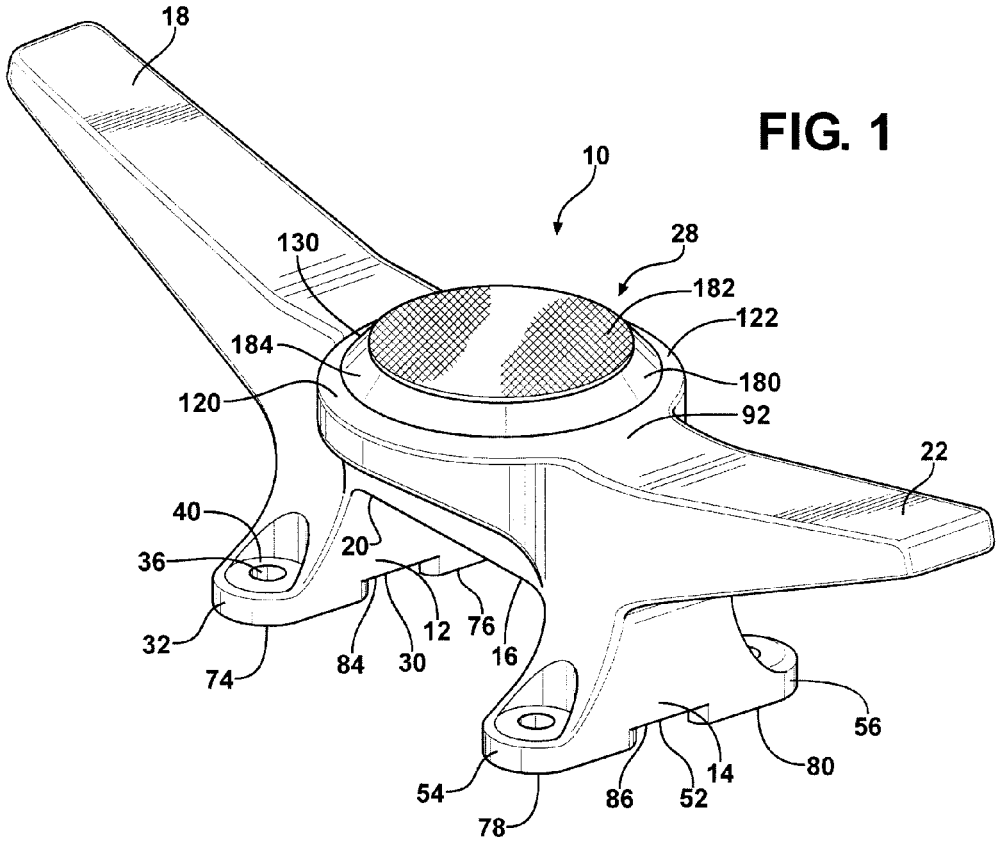
FIG. 1 is a perspective view of the cleat with an illumination module.
Figure 2:
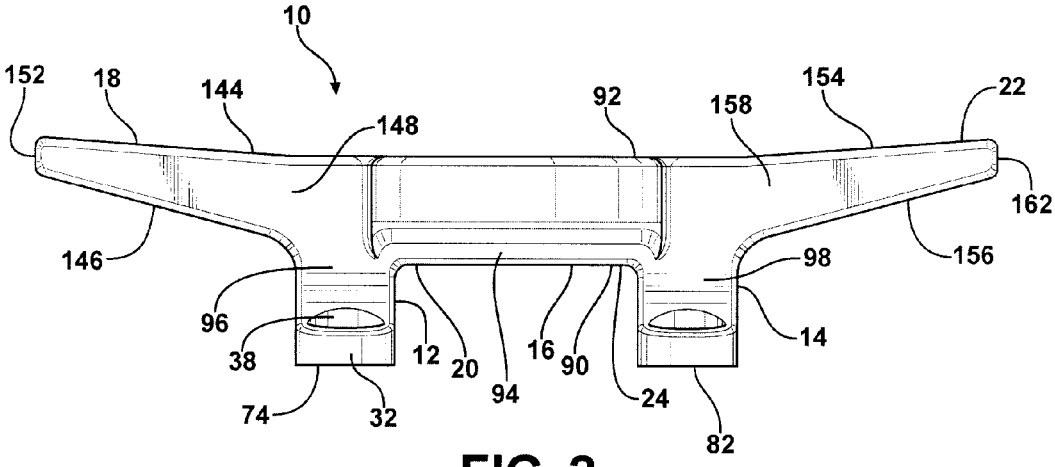
FIG. 2 is a side elevational view of the cleat without an illumination module.
Figure 3:
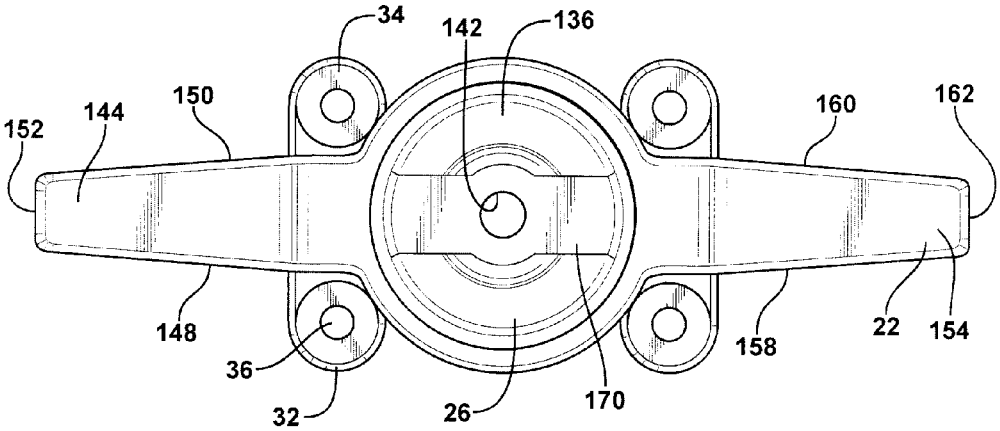
FIG. 3 is a reduced top plan view of the cleat without an illumination module.
Figure 4:
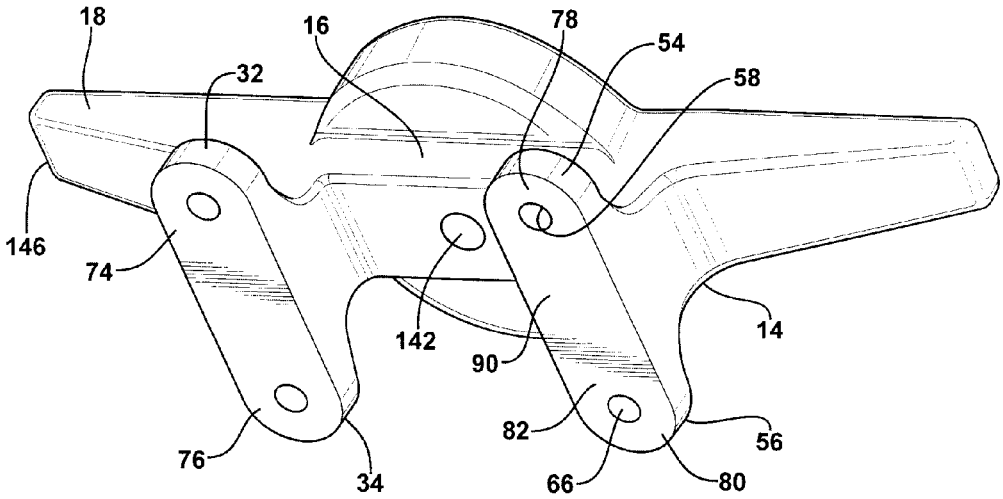
FIG. 4 is a perspective view showing the bottom of the cleat.

The cleat 10 includes a first column 12 and a second column 14. A bridge 16 connects the first column 12 to the second column 14. A first horn 18 is integral with the first column 12 and the bridge 16 and extends laterally outward from a first bridge end 20 of the bridge. A second horn 22 is integral with the second column 14 and the bridge 16 and extends laterally outward from the second bridge end 24 of the bridge. An illumination module cavity 26 is formed in the center of the bridge 16. An illumination module 28 is mounted in the illumination module cavity 26.

The first column 12 has a base 30 with a first wing 32 and a second wing 34. Both the first wing 32 and the second wing 34 extend outward from opposite sides of the first column 12. The first wing 32 has a first vertical bore 36 with a counter bore 38. A counter bore floor 40 of the first vertical bore 36 is perpendicular to a first bore axis 42. The second wing 34 has a second vertical bore 44 with a second counter bore 46. The second counter bore floor 48 is perpendicular to a second bore axis 50. The second column 14 has a base 52 with a third wing 54 and a fourth wing 56 Both the third wing 54 and the fourth wing 56 extend outward from opposite sides of the second column 14. The third wing 54 has a third vertical bore 58 with a counter bore 60. A counter bore floor 62 of the third vertical bore 58 is perpendicular to a third bore axis 64. The forth wing 56 has a forth vertical bore 66 with a counter bore 68. A counter bore floor 70 of the fourth vertical bore 66 is perpendicular to a fourth bore axis 72. A bottom surface 74 of the first wing 32, a bottom surface 76 of the second wing 34, a bottom surface 78 of the third wing 54 and a bottom surface 80 of the fourth wing 56 are all in a common base plane 82. The first bore axis 42, the second bore axis 50, the third bore axis 64 and the fourth bore axis 72 are perpendicular to the common base plane 82. There is a recess 84 in the base 30 of the first column 12 between the bottom surface 74 of the first wing 32 and the bottom surface 76 of the second wing 34. There is also a recess 86 in the base 52 of the second column 14 between the bottom surface 78 of the third wing 54 and the bottom surface 80 of the fourth wing 56. The recess 84 and the recess 86 insure that the cleat 10 has four separate bottom surfaces 74, 76, 78 and 80 that are clamped to the surface of a watercraft. If the watercraft contact surfaces are not in a common plane shims or wedges can be added to securely clamp the cleat 10 to a watercraft. The counter bores 38, 46, 60 and 68 receive the heads of bolts employed to clamp the cleat to a watercraft.

The bridge 16 extends horizontally from upper end of the first column 12 to the upper end of the second column 14. The bridge has a bridge bottom surface 90 and a bridge top surface 92. The bridge bottom surface 90 is parallel to the base plane 82. The bridge top surface 92 is parallel to the bridge bottom surface 90. The bridge bottom surface 90 is mid way between the bridge top surface 92 and the base plane 82. A bridge first side 94 extends from a column first side 96 of the first column 12 to a column first side 98 of the second column 14. A bridge second side 100 extends from a column second side 102 of the first column 12 to a column second side 104 of the second column 14.

The center portion of the bridge 16 includes a first side cavity wall 106 and the second side cavity wall 108. The first side cavity wall 106 has an outer surface 110 and a second side cavity wall 108 has an outer surface 114 that are both portions of a cylindrical surface with a vertical cylinder axis 116. The vertical cylindrical axis 116 passes through the center of the bridge 16 and is perpendicular to the base plane 82. The top 120 of the first side cavity wall 106 is at the same elevation as the bridge top surface 92. The top 122 of the second side cavity wall 108 is at the same elevation as the top 120 of the first side cavity wall 106. A first side cavity bottom wall 124 closes the space between the bottom of the first side cavity wall 106 and the bridge first side 94. A second side cavity bottom wall 126 closes the space between the bottom of the second side cavity wall 108 and the bridge second side 100. The first side cavity bottom wall 124 and the second side cavity bottom wall 126 are spaced above the bridge bottom surface 90.

Figure 5:
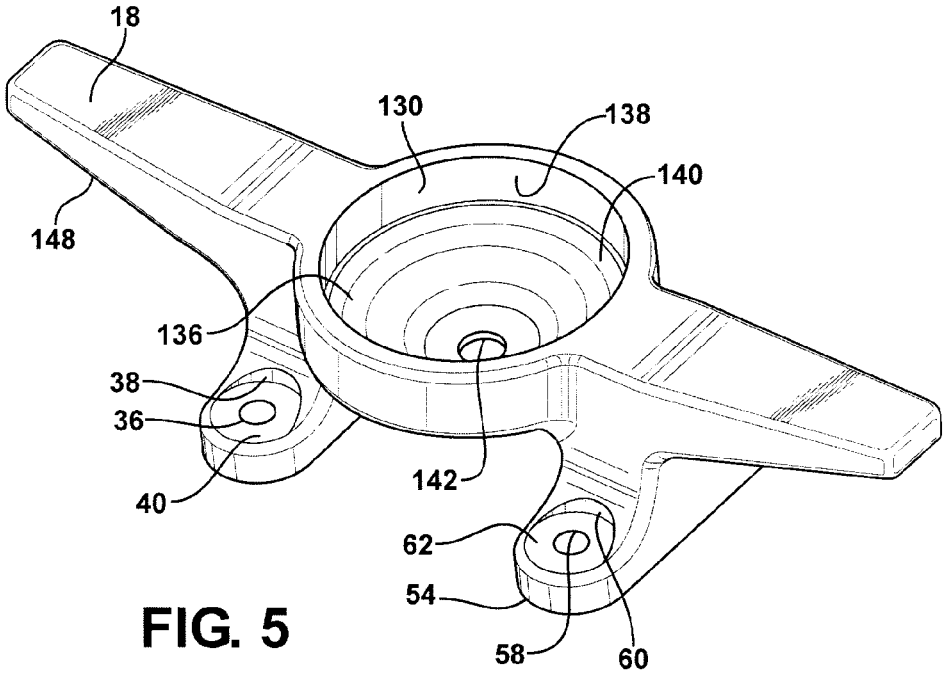
FIG. 5 is a perspective view showing the top of the cleat and the inside of the illumination module cavity.

The first side cavity wall 106, the second side cavity wall 108, the first side cavity bottom wall 124, the second side cavity bottom wall 126, and a portion of the bridge 16 house an illumination module cavity 130. The illumination module cavity 130 includes a cavity inside surface 132. An open top 134 of the illumination module cavity 130 faces upwardly. The cavity inside surface 132 includes a generally cylindrical surface 138 that extends downwardly from the open top 134. The cylindrical surface 138 is coaxial with the vertical cylinder axis 116. The cylindrical surface 138 intersects a bottom surface 140 on the first side cavity bottom wall 124 and the second side cavity bottom wall 126. A light passage aperture 142 is provided in the center of the bottom surface 140. The light passage aperture 142 is coaxial with the vertical cylinder axis 116. In this location, the light passage aperture 142 passes through a portion of the bridge 16 between the first side cavity bottom wall 124 and the second side cavity bottom wall 126. The bottom surface 140 extends downwardly and inwardly from the cylindrical surface 138 to the light passage aperture 142 as shown in FIG. 5.

A first horn 18 is integral with the first column 12 and the center bridge 16. The first horn 18 has a horn flat top surface 144 that extends outward from the bridge top surface 92 and slightly upward. The first horn 18 also has a first horn bottom surface 146 that extend outwardly from the first column 12. The bottom surface 146 also extends upwardly, from the first column 12, at a larger angle from horizontal than the flat top surface 144. The first horn 18 also has a vertical first side surface 148 and a vertical second side surface 150. The first side surface 148 and the vertical second side surfaces 150 converge toward each other from the first column 12 to the first horn free tip 152.

A second horn 22 is integral with the second column 14 and the center bridge 16. The second horn 22 has a horn flat top surface 154 that extends outward from the bridge top surface 92 and upwardly at a slight angle from horizontal. The second horn 22 also has a second horn bottom surface 156 that extends outwardly the second column 14. The bottom surface 156 also extends upwardly, from the second column 14, at a larger angle from horizontal than the flat top surface 154. The second horn 22 also has a vertical first side surface 158 and a vertical second side surface 160. The first side surface 158 and the vertical second side surface 160 converge toward each other from the second column 14 to the second horn free tip 162.

Figure 6:
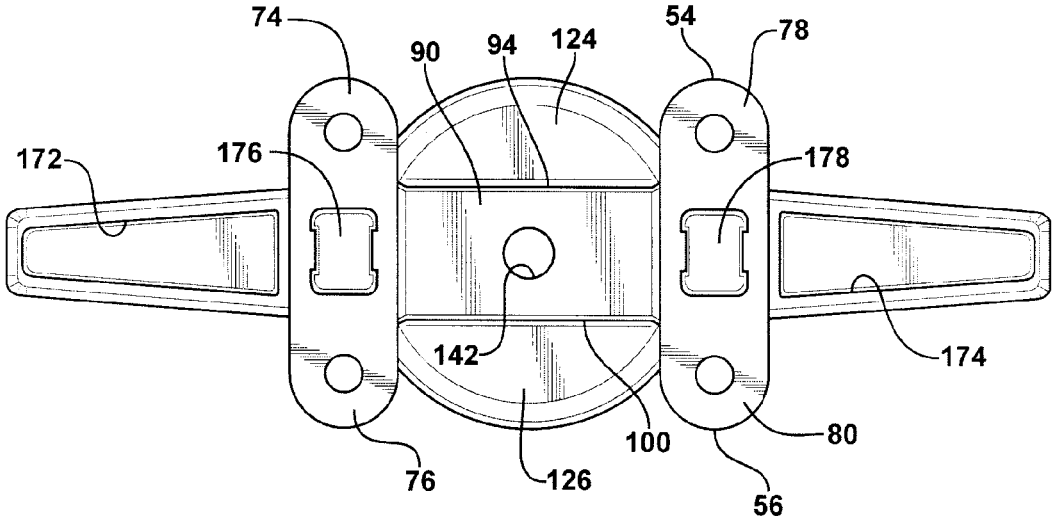
FIG. 6 is a reduced bottom plan view of the cleat.
Figure 7:
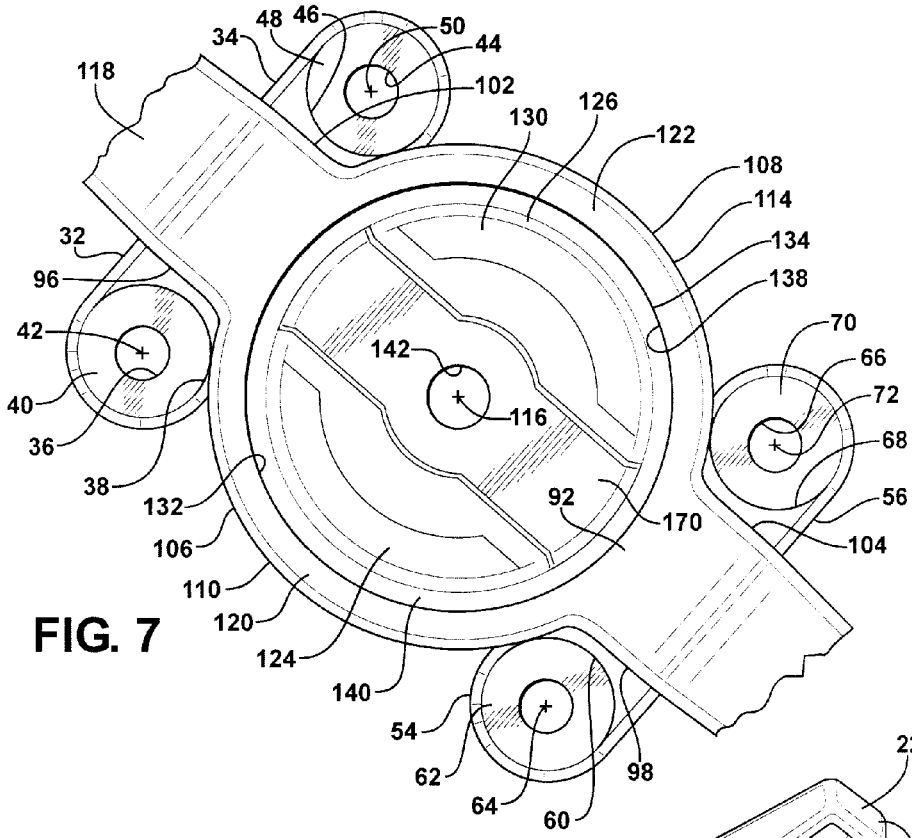
FIG. 7 is an enlarged top plan view of the cleat and the inside of the illumination module cavity with parts broken away.
Figure 8:
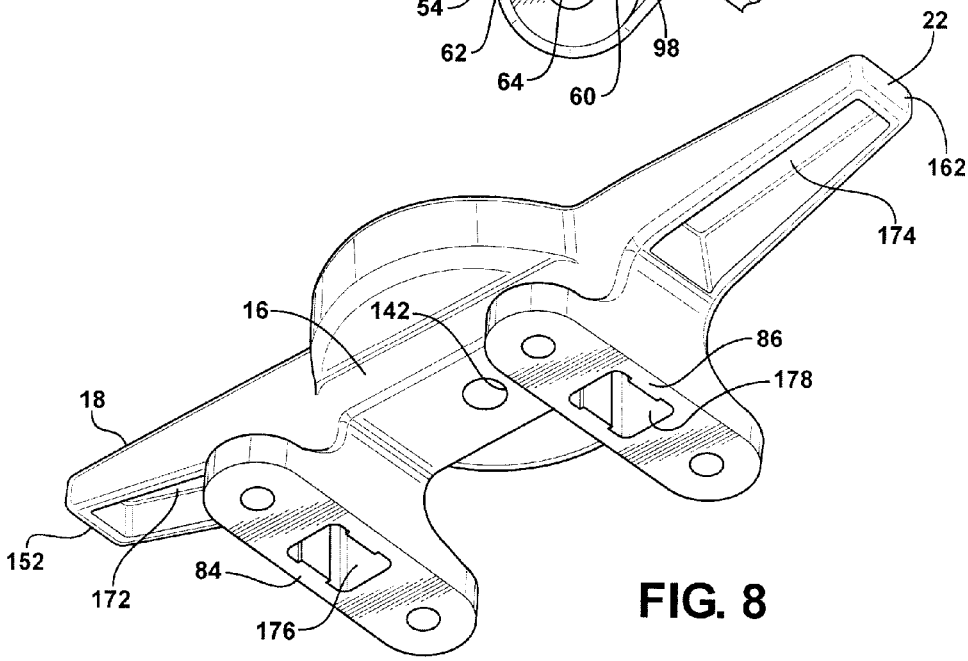
FIG. 8 is a perspective view similar to FIG. 4, of a modified cleat.
Figure 9:
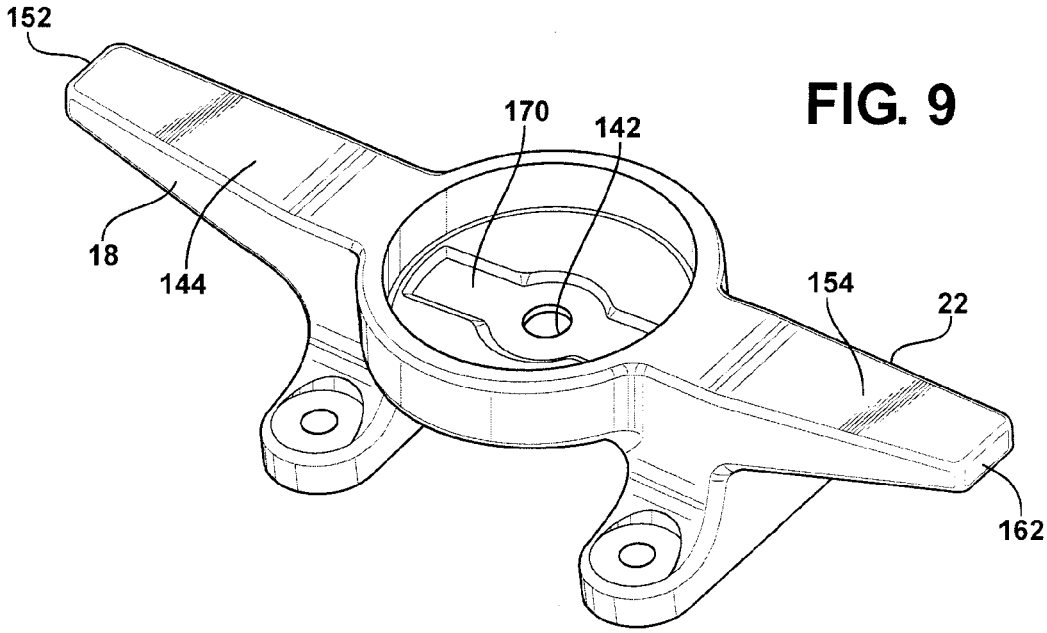
FIG. 9 is a perspective view similar to FIG. 5.

The cleat 10 is injection molded from a high strength plastic material. Weight can be reduced and mold cycle time can be reduced by forming voids in portions of the cleat 10 to obtain a more uniform material thickness throughout the cleat 10. These voids include an illumination module cavity recess 170 shown in FIGS. 7 and 9. The illumination module cavity 170 is in the bridge 16 and the bottom surface 140 of the illumination module cavity 130. FIGS. 6 and 8 shows horn recesses 172 and 174 in the bottom of the first horn 18 and the second horn 22 respectively. FIGS. 6 and 8 show a column recess 176 in the bottom of the first column 12. A column recess 178 is also provided in the bottom of the second column 14 as shown in FIGS. 6 and 8.

Figure 10:
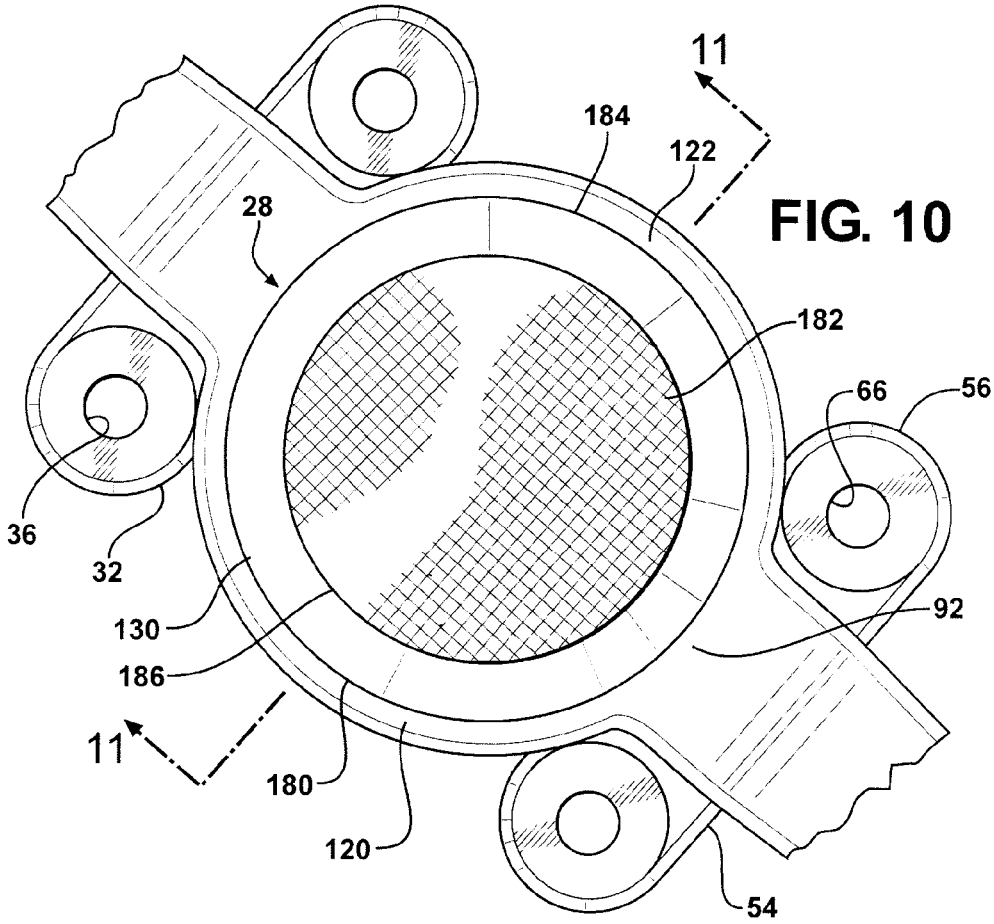
FIG. 10 is an enlarged top plan view of the illumination module and a portion of the cleat with parts broken away.
Figure 11:
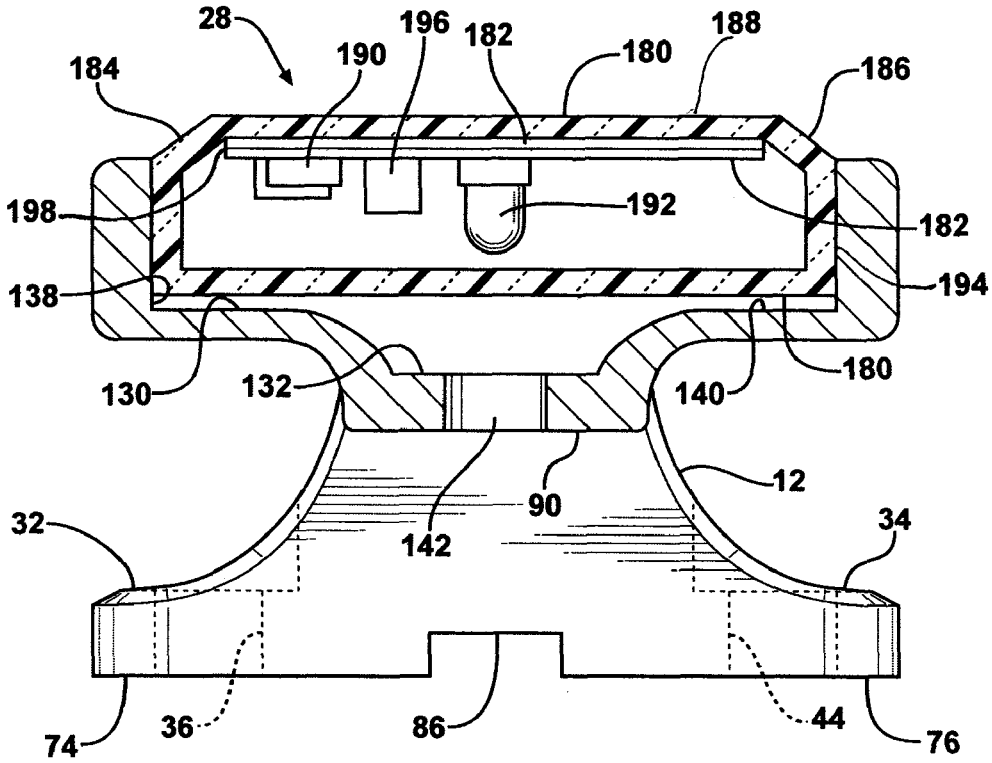
FIG. 11 is a sectional view taken along line 11-11 FIG. 10.

The illumination module 28 shown in FIGS. 1 and 10 includes a sealed transparent plastic case 180. A photovoltaic cell array 182 is mounted in the top center of the module 28 adjacent to the case top wall 188. In this position, the photovoltaic cell array 182 receives light from the sun and other light sources and produces a voltage. The voltage charges a battery 190. The battery 190 stores energy during periods of daylight. During periods of reduced light, the battery 190 is connected by a controller 196 to a light source such as a light emitting diode 192 (LED). The LED 192 directs light toward the light passage aperture 142. Light that passes through the light passage aperture 142 illuminates the surface of a vessel directly under the bridge 16. Some light emitted by the LED illuminates the interior of illumination module cavity 130. The cavity inside surface 132 reflects light through the transparent plastic case 180. The light passes horizontally through an upper side wall 184 of the plastic case 180 and can be seen 360 degrees around the plastic case. The light is also directed vertically upward around the outer edge 186 of the transparent plastic case 180. The outer edge 198 of the photovoltaic cell array 182 has a diameter that is less than the diameter of the transparent plastic case 180 thereby permitting the cleat 10 to be seen from above when illuminated. The cavity inside surfaces 132 including the generally cylindrical surface 138 and the bottom surface 140 can be coated with a reflecting material to increase the illumination brightness.

The illumination module 18 is pressed into the illumination module cavity 130 and held in place by friction. The case radially outer wall 194 engages the cylindrical surface 138. In the event of a failure of illumination module 28, the plastic case 180, together with the components mounted in the case, is removed from the cavity 130. A new illumination module 28 is then pressed into the illumination module cavity 130.

I claim:

1. A cleat with illumination comprising:

a bridge including a bridge first end, a bridge second end a bridge first side, a bridge second side, a bridge bottom surface and a bridge top surface;

a first column integral with the bridge first end and extending downward from the bridge bottom surface, and a second column integral with the bridge second end and extending downward from the bridge bottom surface;

a first column base integral with the first column, including a first wing extending from a column first side of the first column and away from the bridge first side, a first vertical fastener receiving bore passing through the first wing with a first bore axis, a second wing extending from a column second side of the first column and away from the bridge second side, a second vertical fastener receiving bore with a second bore axis passing through the second wing and wherein the second bore axis is parallel to the first bore axis;

a second column base integral with the second column, including a third wing extending from a column first side of the second column and away from the bridge first side, a third vertical fastener receiving bore passing through the third wing with a third bore axis, a fourth wing extending from a column second side of the second column and away from the bridge second side, and a fourth vertical fastener receiving bore with a fourth bore axis passing through the fourth wing and wherein the fourth bore axis is parallel to the third bore axis;

a first horn integral with the first column, extending away from the bridge first end, and extending to a first horn free tip that extends above the bridge top surface;

a second horn integral with the second column, extending away from the bridge second end, and extending to a second horn free tip that extends above the bridge top surface;

an illumination module cavity including a first side cavity wall integral with the bridge, extending laterally outward from the bridge first side, including a first side cavity wall top surface that is at the same elevation as the bridge top surface, a first side cavity bottom wall integral with the first side cavity wall and the bridge and above the bridge bottom surface, a second side cavity wall integral with the bridge, extending laterally outward from the bridge second side, including a second side cavity wall top surface that is at the same elevation as the bridge top surface, a second side cavity bottom wall integral with the second side cavity wall and the bridge and above the bridge bottom surface, a cylindrical cavity wall surface formed by the first side cavity wall, the second side cavity wall and the bridge, a cavity open top and a light passage aperture through the bridge that is coaxial with a vertical cylinder axis of the cylindrical cavity wall surface;

an illumination module including a transparent plastic case with a photovoltaic cell array mounted under a case top wall, a light emitting diode mounted in the center of the transparent plastic case below the photovoltaic cell array, an upper side wall of the transparent plastic case exposed above the bridge top surface and exposed between a case radially outer wall and a photovoltaic cell outer edge, and wherein the illumination module is positioned in the illumination module cavity with the photovoltaic cell array facing upward, the light emitting diode in axial alignment with the light passage aperture, and held in the illumination module cavity by friction; and wherein during periods of limited light, the illumination module energizes the light emitting diode, light passes through the light passage aperture and the cavity inside surface, reflects light upward and through the portion of the transparent plastic case exposed around the photovoltaic cell array.

2. A cleat with illumination comprising:

a bridge including a bridge first end, a bridge second end a bridge first side, a bridge second side, a bridge bottom surface and a bridge top surface;

a first column integral with the bridge first end and extending downward from the bridge bottom surface, and a second column integral with the bridge second end and extending downward from the bridge bottom surface;

a first column base integral with the first column, including a first wing extending from a column first side of the first column and away from the bridge first side, a first vertical fastener receiving bore passing through the first wing, a second wing extending from a column second side of the first column and away from the bridge second side, and a second vertical fastener receiving bore passing through the second wing;

a second column base integral with the second column, including a third wing extending from a column first side of the second column and away from the bridge first side, a third vertical fastener receiving bore passing through the third wing with a fourth wing extending from a column second side of the second column and away from the bridge second side, and a fourth vertical fastener receiving bore passing through the fourth wing;

a first horn integral with the first column, extending away from the bridge first end, and extending to a first horn free tip that extends above the bridge top surface;

a second horn integral with the second column, extending away from the bridge second end, and extending to a second horn free tip that extends above the bridge top surface;

an illumination module cavity including a first side cavity wall integral with the bridge, extending laterally outward from the bridge first side, including a first side cavity wall top surface that is at the same elevation as the bridge top surface, a first side cavity bottom wall integral with the first side cavity wall and the bridge and above the bridge bottom surface, a second side cavity wall integral with the bridge, extending laterally outward from the bridge second side, including a second side cavity wall top surface that is at the same elevation as the bridge top surface, a second side cavity bottom wall integral with the second side cavity wall and the bridge and above the bridge bottom surface, a cylindrical cavity wall surface formed by the first side cavity wall, the second side cavity wall and the bridge, a cavity open top and a light passage aperture through the bridge that is coaxial with a vertical cylinder axis of the cylindrical cavity wall surface;

an illumination module including a transparent plastic case with a photovoltaic cell array mounted under a case top wall, a light emitting diode mounted in the center of the transparent plastic case below the photovoltaic cell array, an upper side wall of the transparent plastic case exposed above the bridge top surface and exposed between a case radially outer wall and a photovoltaic cell outer edge, and wherein the illumination module is positioned in the illumination module cavity with the photovoltaic cell array facing upward, the light emitting diode in axial alignment with the light passage aperture, and held in the illumination module cavity by friction; and wherein during periods of limited light, the illumination module energizes the light emitting diode, light passes through the light passage aperture.

3. A cleat with illumination comprising:

a bridge including a bridge first end, a bridge second end a bridge first side, a bridge second side, a bridge bottom surface and a bridge top surface;

a first column integral with the bridge first end and extending downward from the bridge bottom surface, and a second column integral with the bridge second end and extending downward from the bridge bottom surface;

a first column base integral with the first column, including a first wing extending from a column first side of the first column and away from the bridge first side, a first vertical fastener receiving bore passing through the first wing with a first bore axis, a second wing extending from a column second side of the first column and away from the bridge second side, and a second vertical fastener receiving bore passing through the second wing;

a second column base integral with the second column, including a third wing extending from a column first side of the second column and away from the bridge first side, a third vertical fastener receiving bore passing through the third wing with a third bore axis, a fourth wing extending from a column second side of the second column and away from the bridge second side, and a fourth vertical fastener receiving bore with a fourth bore axis passing through the fourth wing and wherein the fourth bore axis is parallel to the third bore axis;

a first horn integral with the first column, extending away from the bridge first end, and extending to a first horn free tip that extends above the bridge top surface;

a second horn integral with the second column, extending away from the bridge second end, and extending to a second horn free tip that extends above the bridge top surface;

an illumination module cavity including a first side cavity wall integral with the bridge, extending laterally outward from the bridge first side, including a first side cavity wall top surface that is at the same elevation as the bridge top surface, a first side cavity bottom wall integral with the first side cavity wall and the bridge and above the bridge bottom surface, a second side cavity wall integral with the bridge, extending laterally outward from the bridge second side, including a second side cavity wall top surface that is at the same elevation as the bridge top surface, a second side cavity bottom wall integral with the second side cavity wall and the bridge and above the bridge bottom surface, a cylindrical cavity wall surface formed on the first side cavity wall, the second side cavity wall and the bridge, a cavity open top and a light passage aperture through the bridge that is coaxial with a vertical cylinder axis of the cylindrical cavity wall surface;

an illumination module including a transparent plastic case with a photovoltaic cell array mounted under a case top wall, a light emitting diode mounted in the center of the transparent plastic case below the photovoltaic cell array, an upper side wall of the transparent plastic case exposed above the bridge top surface and exposed between a case radially outer wall and a photovoltaic cell outer edge, and wherein the illumination module is positioned in the illumination module cavity with the photovoltaic cell array facing upward, the light emitting diode in axial alignment with the light passage aperture, and held in the illumination module cavity by friction; and wherein during periods of limited light, the illumination module energizes the light emitting diode, light passes through the light passage aperture and a cavity inside surface, reflects light upward and through the portion of the transparent plastic case exposed above the bridge top surface and the photovoltaic cell outer edge.

4. A cleat with illumination, as set forth in claim 3, wherein the first column base includes a first cleat support bottom surface on the first wing, a second cleat support bottom surface on the second wing, and the second column base includes a third cleat support bottom surface on the third wing and a fourth cleat support bottom surface on the fourth wing.

5. A cleat with illumination, as set forth in claim 4, wherein the first cleat support bottom surface, the second cleat support bottom surface, the third cleat support bottom surface, and the fourth cleat support bottom surface are in a common plane.

* * * * *